US009247807B1

(12) United States Patent
Sanchez

(10) Patent No.: US 9,247,807 B1
(45) Date of Patent: Feb. 2, 2016

(54) BUFFET SERVING AND SEATING TABLE

(71) Applicant: Savino I. Sanchez, Roswell, NM (US)

(72) Inventor: Savino I. Sanchez, Roswell, NM (US)

( * ) Notice: Subject to any disclaimer, the term of this patent is extended or adjusted under 35 U.S.C. 154(b) by 0 days.

(21) Appl. No.: 14/208,483

(22) Filed: Mar. 13, 2014

Related U.S. Application Data

(60) Provisional application No. 61/791,569, filed on Mar. 15, 2013.

(51) Int. Cl.
*A47B 37/00* (2006.01)
*A47B 13/08* (2006.01)
*A47B 31/04* (2006.01)

(52) U.S. Cl.
CPC ..... *A47B 13/08* (2013.01); *A47B 31/04* (2013.01); *A47B 37/00* (2013.01)

(58) Field of Classification Search
USPC ..... 108/25, 26
See application file for complete search history.

(56) References Cited

U.S. PATENT DOCUMENTS

| | | | | |
|---|---|---|---|---|
| D290,663 | S | 7/1987 | Jung | |
| 5,060,580 | A * | 10/1991 | Shaw | 108/25 |
| 5,720,226 | A | 2/1998 | Padovano | |
| 5,778,800 | A | 7/1998 | Liang | |
| 6,460,924 | B1 | 10/2002 | Josephs | |
| 6,499,411 | B2 | 12/2002 | Brown | |
| 6,766,747 | B1 * | 7/2004 | Wolfe | 108/26 |
| 6,997,111 | B2 | 2/2006 | Giegerich | |
| 7,779,762 | B2 * | 8/2010 | Sackman | 108/25 |
| 8,166,893 | B2 | 5/2012 | Davis | |
| 8,490,551 | B1 * | 7/2013 | Wagner et al. | 108/25 |
| 8,857,346 | B2 * | 10/2014 | Khanjian et al. | 108/26 |
| 2002/0020304 | A1 * | 2/2002 | Reynolds | A47J 36/24 99/339 |
| 2007/0056482 | A1 * | 3/2007 | Robinson et al. | 108/25 |
| 2008/0000394 | A1 | 1/2008 | Luiso | |
| 2009/0050028 | A1 * | 2/2009 | Liao Fang | 108/26 |
| 2011/0088974 | A1 * | 4/2011 | Bond | 182/129 |
| 2012/0048149 | A1 * | 3/2012 | Pendleton | 108/13 |
| 2014/0069304 | A1 * | 3/2014 | Elstad | 108/26 |

FOREIGN PATENT DOCUMENTS

| | | |
|---|---|---|
| JP | 2007190338 | 8/2007 |
| JP | 2012111314 | 6/2012 |

OTHER PUBLICATIONS

Cool Idea: A Picnic Table for Winos; by Julia Millay Walsh Jul. 27, 2011; http://www.casasugar.com/Wine-Cooler-Picnic-Table-Medlock-Ames-18439772.

Picnic table has eight cup holders; Posted : Sep. 5, 2011; http://www.globalsources.com/si/AS/Xiamen-Charmlite/6008823619112/2000000003844/3000000149681.htm.

* cited by examiner

*Primary Examiner* — Daniel Rohrhoff
(74) *Attorney, Agent, or Firm* — Jeffrey D. Myers; Isaac Estrada; Peacock Myers, P.C.

(57) ABSTRACT

A portable buffet style serving and seating table comprising a table body box with one or more hollow compartments for placing food containers.

7 Claims, 10 Drawing Sheets

BUFFET SERVING AND SEATING TABLE

CROSS-REFERENCE TO RELATED APPLICATIONS

This application claims priority to and the benefit of the filing of U.S. Provisional Patent Application Ser. No. 61/791,569, entitled "BUFFET SERVING AND SEATING TABLE", filed on Mar. 15, 2013, and the specification, drawings, and claims thereof are incorporated herein by reference.

BACKGROUND OF THE INVENTION

1. Field of the Invention (Technical Field)

The present invention relates generally to portable furniture and, more particularly, to a foldable and portable table for indoor or outdoor use.

2. Description of Related Art

Portable tables are known in the art. Portable tables are practical for social gatherings indoors or outdoors. For the most part, portable tables comprise only a flat surface for placing food, plates, eating utensils, drinks, etc. Food and drink containers can be easily knocked down, particularly when multiple people are trying to have access to these containers and are using the table top to place their food and drinks at the same time. In addition, portable tables presently used, do not block dust, or insects from contaminating open food and drink containers. Also, portable tables presently used do not prevent wind from overturning food and drink containers or blowing away light items such napkins, paper plates, etc. A need exists for portable tables that can be used efficiently to serve food and to seat at without all these inconveniences.

Embodiments of the present invention solve this problem by providing tables comprising a compartment openable through one or more lids. In one embodiment, the compartment comprises cavities capable of receiving removable food containers or other items such bags of chips, paper plates, utensils, napkins, combinations thereof, and the like. Such configuration allows one or more users to enclose the food and other items after procuring their food/drinks, utensil, etc., and use the resulting flat surface to eat.

BRIEF SUMMARY OF THE INVENTION

Embodiments of the present invention comprise portable buffet serving and seating tables comprising legs and a table body comprising one or more hollow compartments comprising a bottom, a left side, a right side, a front side and an upper side, the bottom side comprising one or more cavities for receiving removable food containers, upper side comprising one or more openable lids; and one or more openable lids forming a table top when closed. In one embodiment, the legs are foldable. In one embodiment, the cavities are open spaces. Optionally, the cavities comprise nets. In one embodiment, the compartments comprise lift supports to hold the lids open. In one embodiment, the compartments comprise slats for the lids to sit on when in a closed configuration. Preferably, the lids comprise locking mechanisms, for example, a protrusion on the lids that snaps on the side of the slat.

In one embodiment, the table body is collapsible along a central axis that divides it in two connected segments. Optionally, the segments are hingeably connected. In one embodiment, the lids slide to open.

In a different embodiment, the cavities are closed recesses on the bottom side of the compartments.

In one embodiment, the compartments are insulated. In a different embodiment, the containers are insulated.

In a different embodiment of the invention, a method of manufacturing a buffet serving and seating table comprises fabricating components of one or more segments of a table body box comprising an upper portion comprising openings for lids, a bottom comprising cavities, a left side, a right side, a front side, and a back side, assembling the components to form the one or more segments of the table body box such that each segment comprises a hollow compartment, connecting lids on the upper portions of the one or more segments, and connecting the segments of the table body box such that the buffet serving and seating table can fold.

A different embodiment of the invention further comprises disposing legs on the bottom portion of the table body box.

A different embodiment of the invention further comprises disposing one or more lift supports for the lids.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
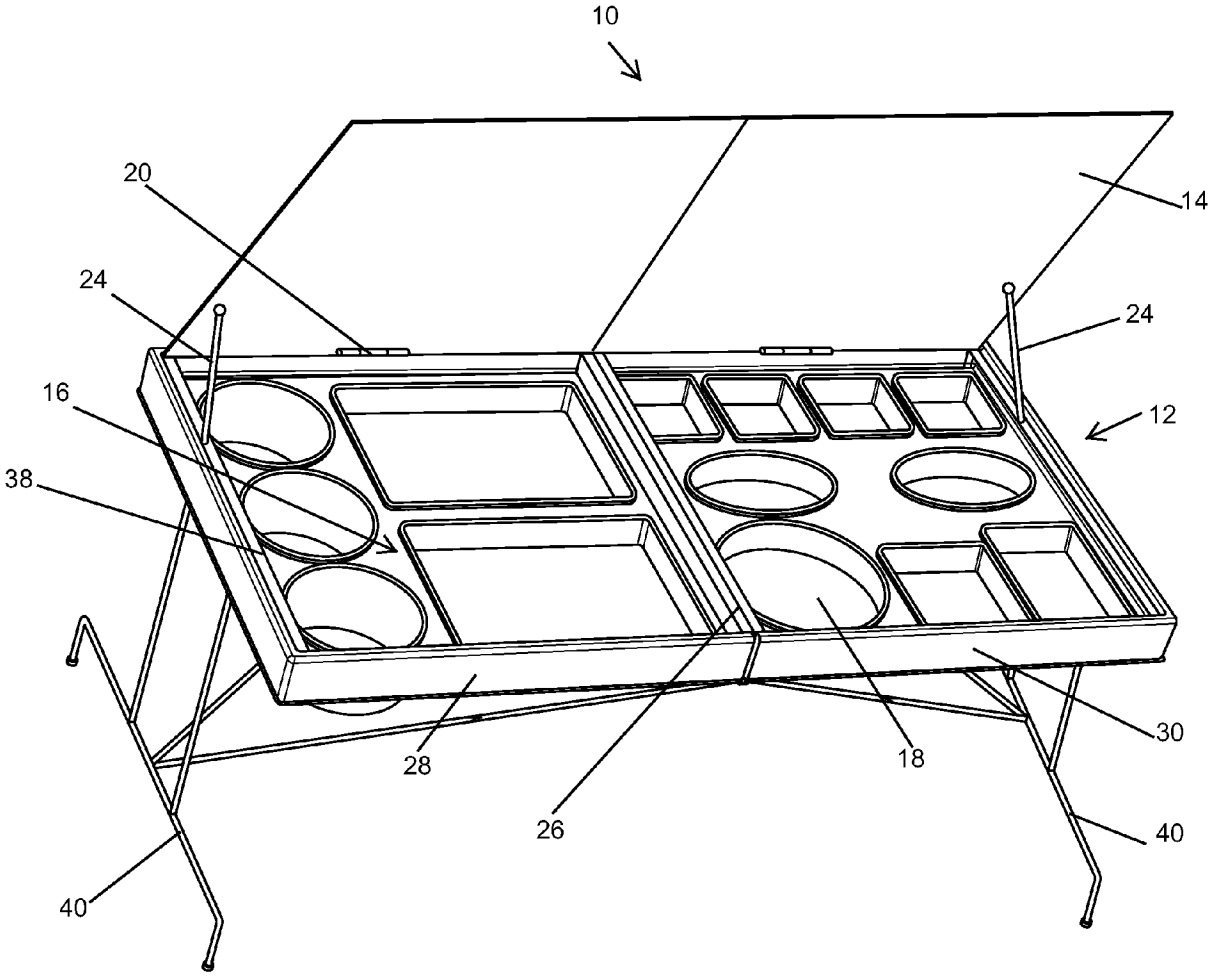
FIG. 1 is a perspective top view of one embodiment of the invention with two open lids and showing containers in the cavities of its compartments.
Figure 2:
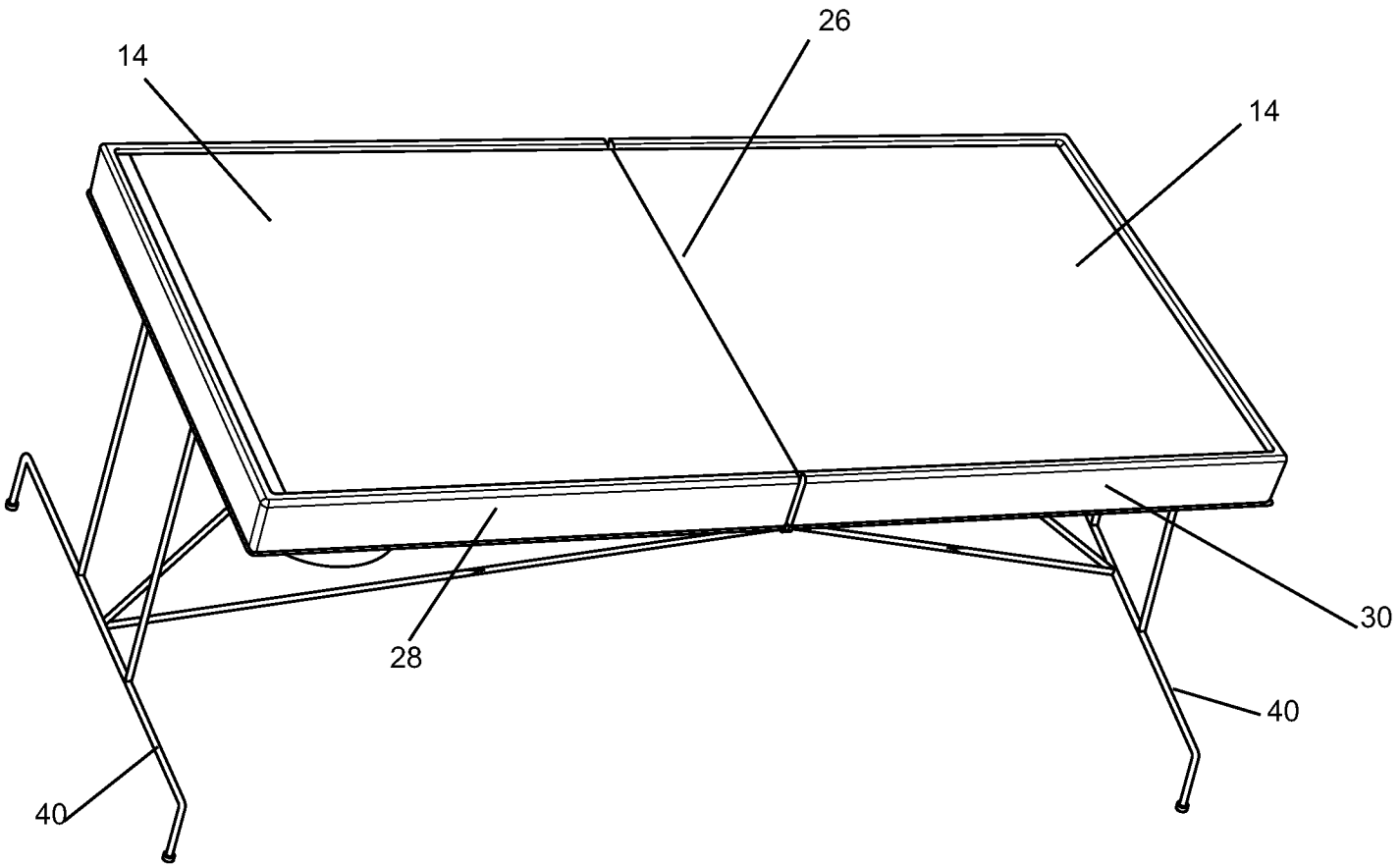
FIG. 2 is a perspective top view of the embodiment of FIG. 1 with the lids closed.
Figure 3:
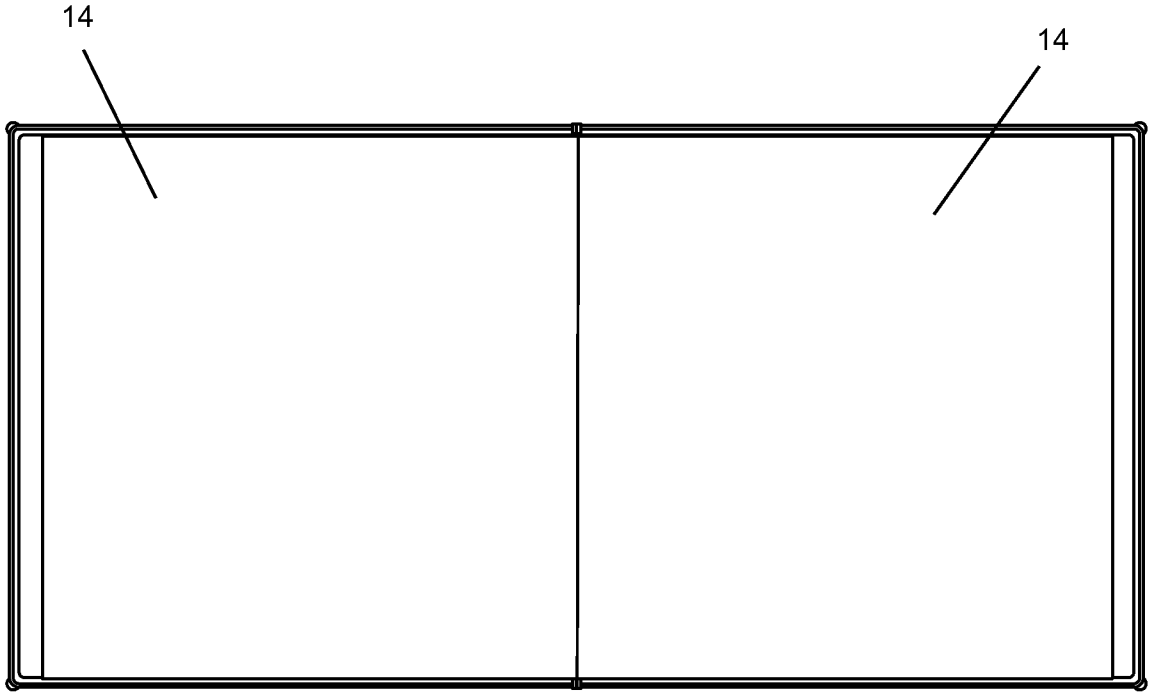
FIG. 3 is a top view of FIG. 2.
Figure 4:
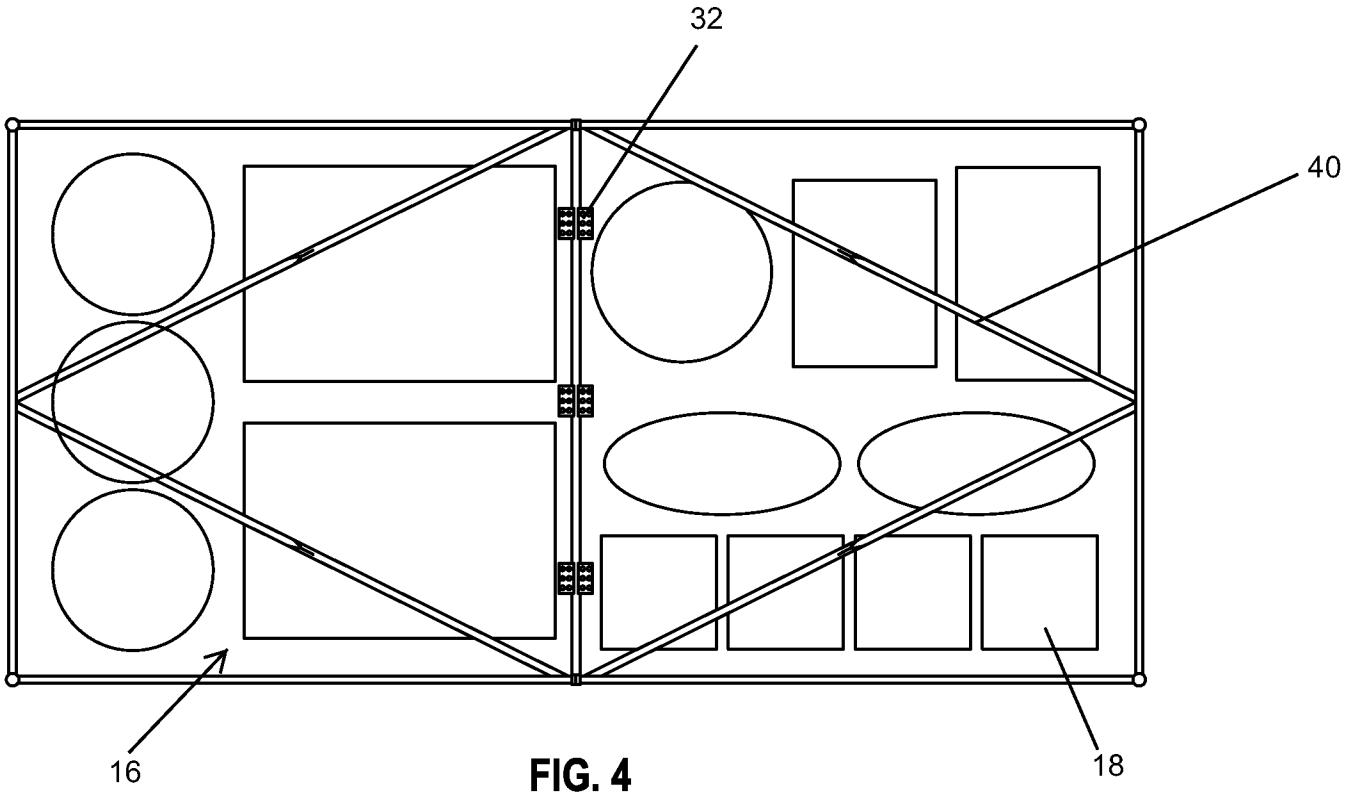
FIG. 4 is a bottom view of FIG. 2.
Figure 5:
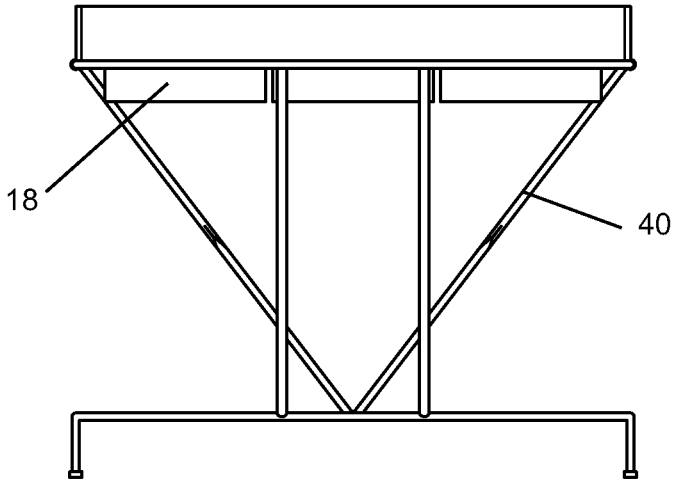
FIG. 5 is a front view of FIG. 2, the back view being significantly the same.

Embodiments of the present invention relate to portable buffet style serving and seating tables, comprising a table body with one or more hollow compartments. In one embodiment, the compartment comprises cavities at its bottom side that are capable of receiving removable containers for holding food. In an alternative embodiment, some of the cavities comprise nets for holding chip bags and/or dispensers, e.g., a napkin disperser. In a further embodiment, the table is foldable for convenient transport. In yet a further embodiment, a table comprises more than one segment and one or more segments comprise openable lids to create compartments and, when closed, flat surfaces for placing food and other items.

As used throughout this application and claims, the term "foldable" refers to diverse mechanisms to make the disclosed furniture, or some of their parts, compact by doubling, bending, or folding.

As used throughout this application and claims, the term "portable" refers to the property of the disclosed furniture to be moved or carried with ease.

As used throughout this application and claims, the term "insulated" refers to covering or lining surfaces with material that aids in maintaining a desired temperature.

Referring to the accompanying drawings, and particularly to FIGS. 1-5 and 7, according to one embodiment of the present invention, buffet serving and seating table 10 comprises a table body box comprising one or more compartments 12, one or more lids 14, and one or more cavities 16, which are capable of receiving one or more food containers 18. Optionally, some cavities 16 comprise nets that can hold, for example, for example one or more bags of chips. In one embodiment, cavities 16 accommodate utensil containers, and/or dispensers, e.g., napkin disperser. Preferably, lids 14 are hinged to table 10 through one or more hinges 20, and can be held open through one or more lift supports 24. In a different embodiment, lids 14 slide to open. Supports 24 can be pressurized or mechanical, twistable, adjustable, combinations thereof, and the like.

In one embodiment, table 10 is foldable along axis 26 for convenient transport and storage. Segments 28 and 30 attach to each other at axis 26, for example, through hinges 32. See FIG. 4. Lids 14 can be secured in place through any locking mechanism, e.g. snapping, latching, plugs, fasteners, combinations thereof, and the like. In a preferred embodiment, a snap locking mechanism for lids 14 is created when a protrusion (not shown) on at least a part of lids 14 locks into a receiving channel on sitting slats 38. Optionally, this protrusion is disposed along the side which sits on slats 38 when lids 14 are shut.

In a preferred embodiment, table 10 comprises foldable legs 40 that preferably fold beneath segments 28 and 30 respectively when table 10 is folded. Foldable legs 40 are preferably manufactured of a suitable material such as steel tubing, aluminum, composite, polymeric materials, wood, etc.

In a preferred embodiment, cavities 16 are openings at the bottom of compartments 12. In a different embodiment, cavities 16 are recesses created either individually for each cavity, e.g., by molding the entire bottom of compartments 12 as a single piece.

Figure 6:
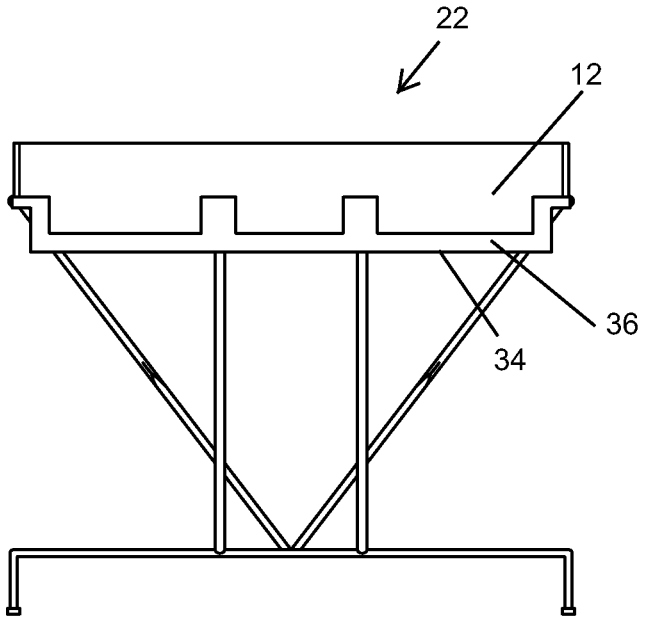
FIG. 6 is a cross sectional view of a different embodiment.
Figure 7:
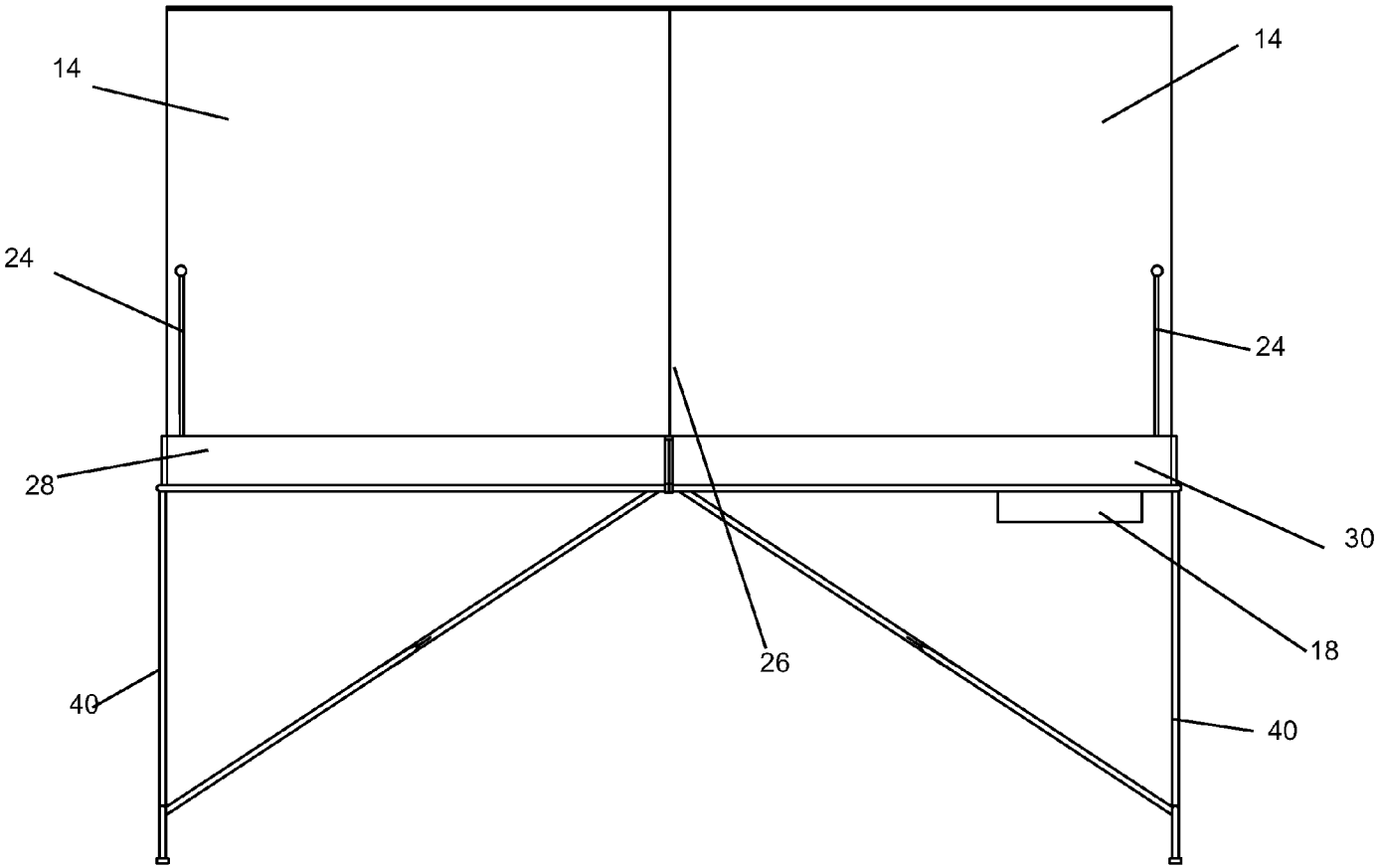
FIG. 7 is a side view of the embodiment of FIG. 2, with the opposite side being significantly the same but without the support lifts.

Referring to FIG. 6, which shows a cross sectional view of an alternative embodiment, table 22 comprises supporting layer 34 below the bottom of compartments 12. Space 36 created between the bottom of compartment 12 and this additional supporting layer 34, which is not occupied by food containers, can optionally be filled, fully or in part, with an insulation material to help maintain the temperature of the food in the containers. Alternatively, some or all of food containers 18 can optionally be insulated containers to accomplish a similar result.

Figure 8:
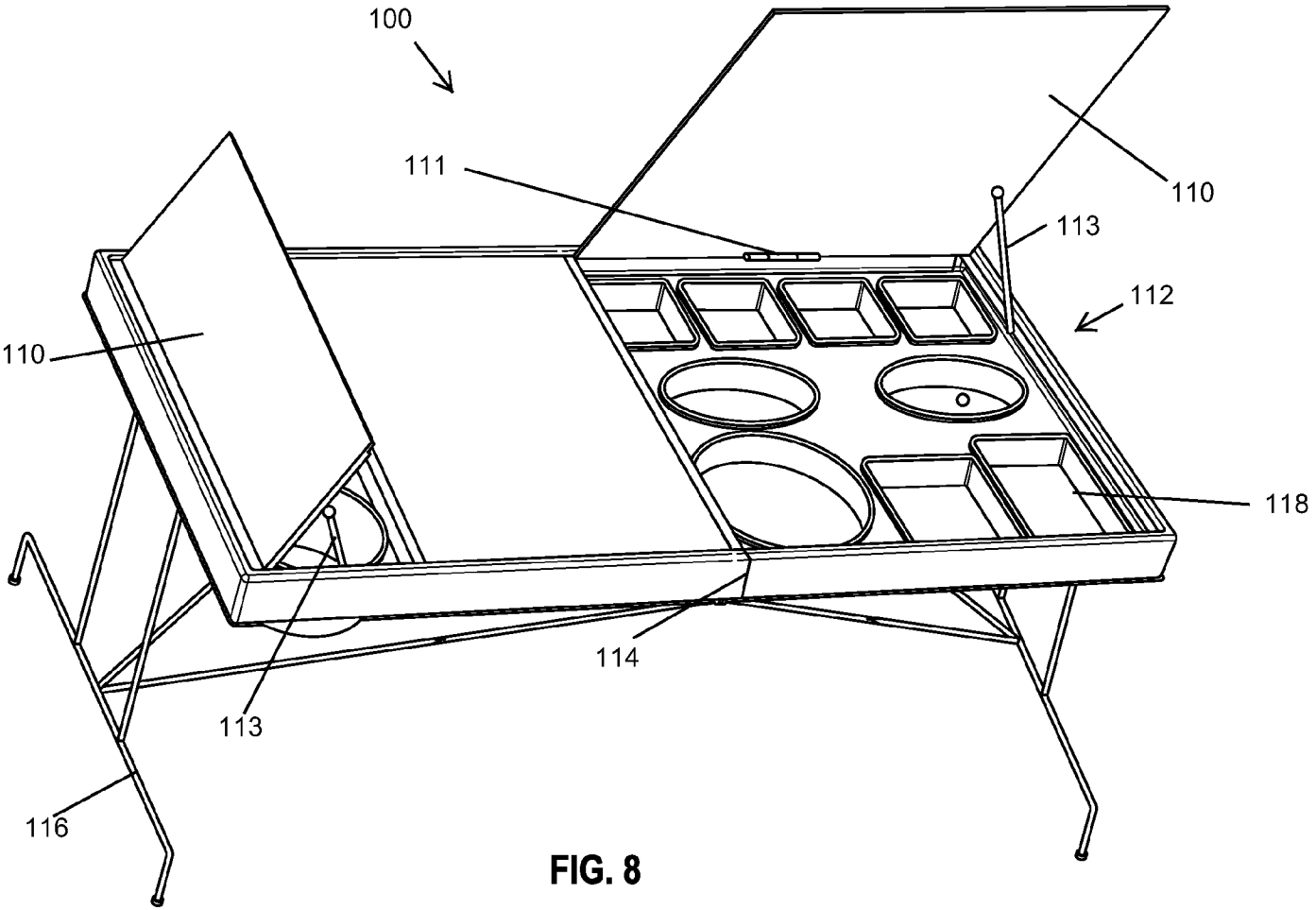
FIG. 8 is a perspective top view of a different embodiment comprising three segments, one lid for each segment, with two lids open and one closed, two of the lids open lengthwise and a third lid opens front wise.

Referring to FIG. 8, in a different embodiment of the invention, table 100 comprises one or more segments, each comprising one or more openable lids 110 and one or more compartments 112. Preferably, lids 110 are hinged to table 100 through one or more hinges 111, and lids 110 can remain open with the aid of support lifts 113. Support lifts 113 can be pressurized or mechanical, twistable, adjustable, combinations thereof, and the like. Preferably table 100 is foldable along axis 114. Legs 116 are also preferably foldable for easier storage and transportation. In one embodiment, one or more segments comprise cavities in compartments 112 to hold removable food containers 118 for buffet style food serving. A third segment can optionally be used for storage and preferably remains closed for flat surface area (i.e., table top) useful for, as an example, punch or fondue fountains, or to seat at for eating.

Figure 9:
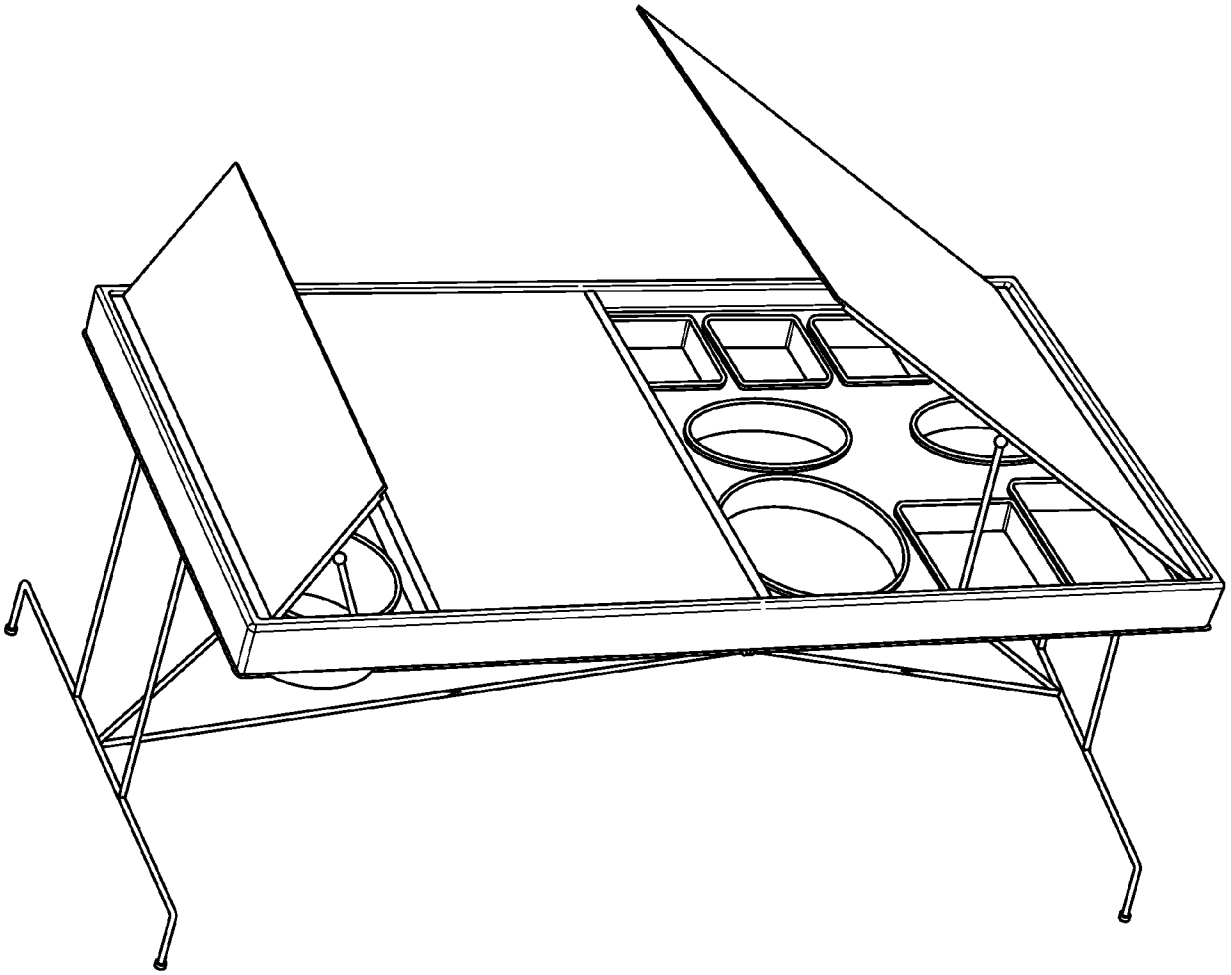
FIG. 9 is a similar embodiment than that of FIG. 8, with the exception that the two side lids open front and back wise.
Figure 10:
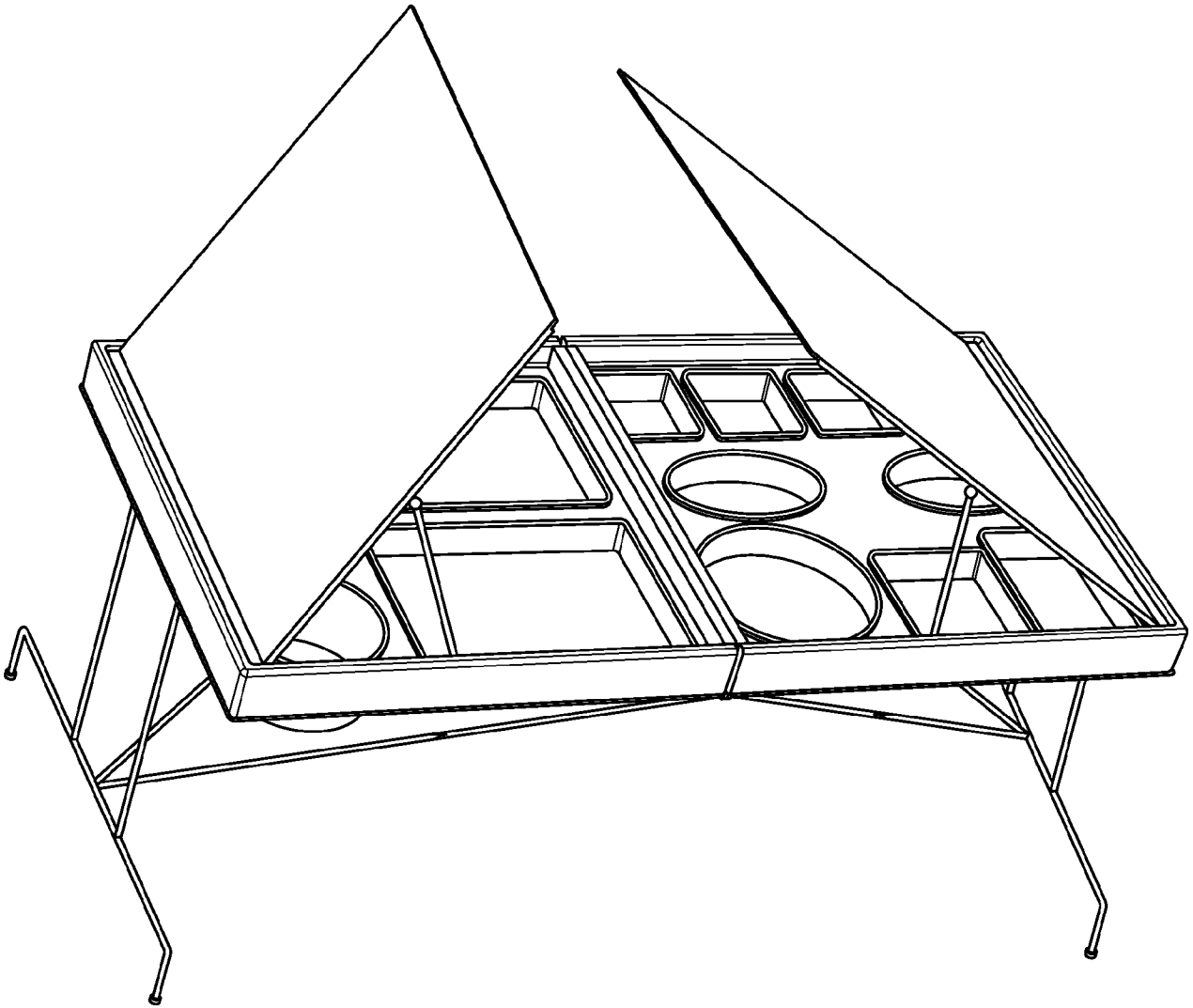
FIG. 10 is a similar embodiment than that of FIG. 1, with the exception that the two lids open front and back wise.
Figure 11:
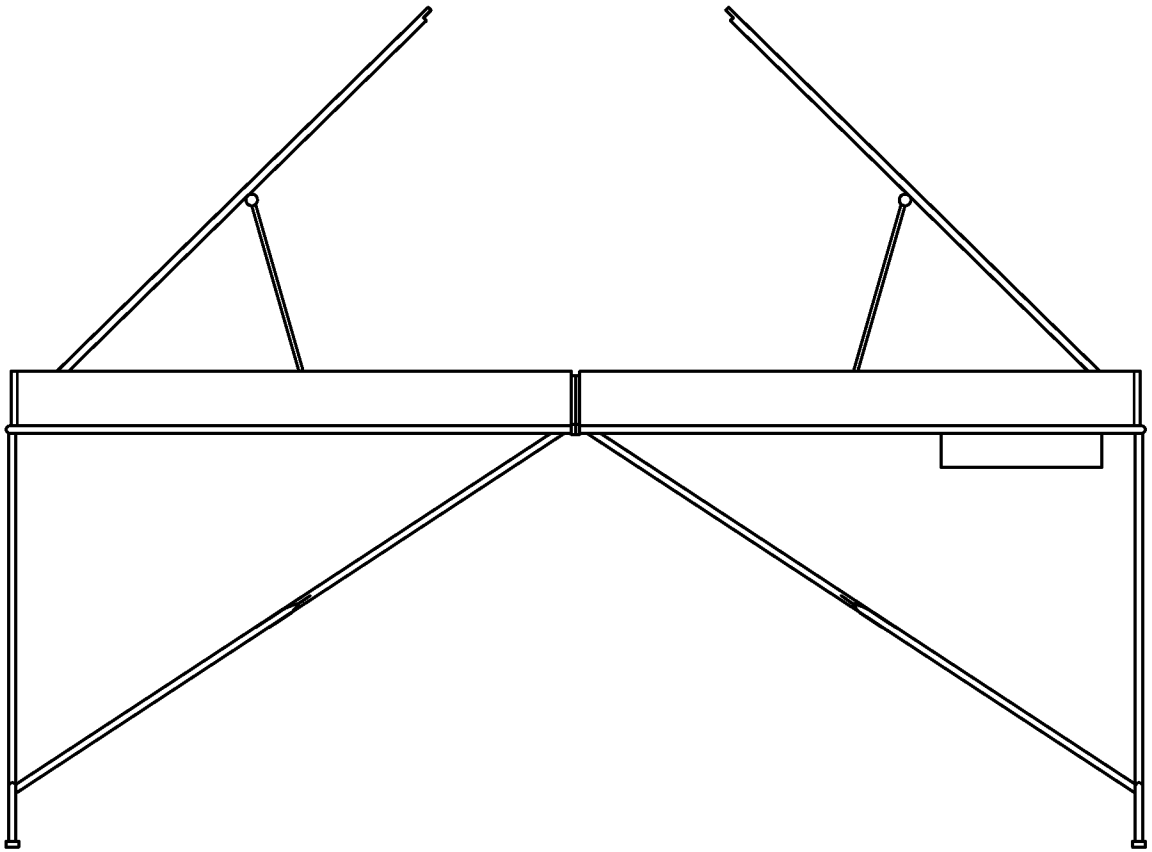
FIG. 11 is a side view of the embodiment of FIG. 10, with its opposite side being a mirror image.

FIG. 9 illustrates a different embodiment of the invention which is similar to the embodiment shown in FIG. 8, with the exception that both lids open toward the ends of the table. FIGS. 10 and 11 also illustrate a different embodiment of the invention similar to the embodiment shown in FIG. 1, except that the lids open toward the ends of the table. FIG. 11 is a side view of the embodiment shown in FIG. 10.

A different embodiment of the invention comprises a method of manufacturing a buffet serving and seating table comprising: fabricating components of one or more segments of a table body box comprising an upper portion comprising openings for lids, a bottom comprising cavities, a left side, a right side, a front side, and a back side, assembling the components to form the one or more segments of the table body box such that each segment comprises a hollow compartment, connecting lids on the upper portions of the one or more segments, and connecting the segments of the table body box such that the buffet serving and seating table can fold.

A different embodiment of the invention further comprises disposing legs on the bottom portion of the table body box.

A different embodiment of the invention further comprises disposing one or more lift supports for the lids.

INDUSTRIAL APPLICABILITY

The invention is further illustrated by the following non-limiting examples.

Example 1

A portable buffet serving and seating table like the one shown in FIG. 1 was manufactured. The table had foldable steel tubing legs and a table body made of molded plastic. The table body was divided in two segments that were connected with hinges to facilitate folding for transportation and storage. Each segment had a hollow compartment. The compartment were accessible through hinged lids and the bottom side of the compartments had open cavities for receiving food containers, nets to place bags of chips, napkin holders, utensil holders, and such. The lids had a locking mechanism to remain closed when needed, e.g., for transportation, and lift supports to keep them open, e.g., for serving food.

The preceding example can be repeated with similar success by substituting the generically or specifically described components and/or operating parameters of this invention for those used in the preceding examples.

Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A portable buffet serving and seating table comprising:

a table body box comprising an upper portion, a bottom, a left side, a right side, a front side, and a back side;

a first, a second, and a third hollow compartments inside said table body box that are accessible through a first, a second, and a third openable lid corresponding to said first, second, and third hollow compartments and disposed on said upper portion;

said first openable lid pivotally openable front wise;

said second and third lids pivotally openable lengthwise;

wherein said first openable lid is pivotally connected to said body box substantially perpendicular to pivotal connections to said body box of said second and third openable lids;

said bottom comprising a lower layer and an upper layer;

said upper layer comprising one or more cavities recessed on said upper layer to form indentations for receiving removable food containers placed inside said one or more hollow compartments;

said lower layer and upper layers being separated to form a space between them;

said space between said lower and upper layer comprising insulating material disposed therein; and said one or more openable lids forming a table top when closed.

2. The portable buffet serving and seating table of claim 1 further comprising legs.

3. The portable buffet serving and seating table of claim 2 wherein said legs are foldable.

4. The portable buffet serving and seating table of claim 1 further comprising lift supports to hold said lids open.

5. The portable buffet serving and seating table of claim 1 wherein said upper portion further comprises slats for said lids to sit on when in a closed configuration.

6. The portable buffet serving and seating table of claim 1 wherein said table body is collapsible along a central axis that divides said table body in two connected segments.

7. The portable buffet serving and seating table of claim 6 wherein said segments are hingeably connected.

* * * * *